US007032366B1

(12) United States Patent
Williams

(10) Patent No.: US 7,032,366 B1
(45) Date of Patent: Apr. 25, 2006

(54) NON-SLIP HORSE SADDLE PAD

(75) Inventor: James A. Williams, 116 Sunlite Rd., Shelbyville, TN (US) 37162

(73) Assignee: James A. Williams, Shelbyville, TN (US)

( * ) Notice: Subject to any disclaimer, the term of this patent is extended or adjusted under 35 U.S.C. 154(b) by 0 days.

(21) Appl. No.: 08/957,494

(22) Filed: Oct. 24, 1997

(51) Int. Cl.
*B68C 1/12* (2006.01)

(52) U.S. Cl. ..... 54/66

(58) Field of Classification Search ..... 54/65, 54/66

See application file for complete search history.

(56) References Cited

U.S. PATENT DOCUMENTS 4,695,496 A * 9/1987 Lee ..... 54/66 X
4,827,701 A * 5/1989 Gonzales ..... 54/66
5,497,602 A * 3/1996 Arnold ..... 54/66 X
5,575,139 A * 11/1996 Green ..... 54/66

* cited by examiner

*Primary Examiner*—Robert P. Swiatek
(74) *Attorney, Agent, or Firm*—James A. Williams

(57) ABSTRACT

A saddle pad apparatus constructed from a first non-slip top layer which is stitched or welded to a second non-slip bottom layer with a stiffening layer contained between the top and bottom layers. Each layer is constructed from a poly vinyl chloride impregnated scrim. Each scrim is constructed with ventilation openings to allow for proper ventilation between the load being carried and the animal. The scrims are manufactured by applying a poly vinyl chloride material onto a fiber network with fibers areas and open areas to create a scrim with appropriate stiffness, softness, and ventilation while maintaining other appropriate characteristics.

20 Claims, 4 Drawing Sheets

NON-SLIP HORSE SADDLE PAD

CROSS REFERENCE TO RELATED APLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not applicable.

BACKGROUND OF THE INVENTION

1. Field of the Invention

The present invention is directed to an apparatus and method for a saddle pad for animals. More particularly, the invention is directed for use in a Non-Slip and Ventilated Horse Saddle Pad. The invention has utility in applications for horse saddle pads, animal cushioning pads, and the like.

2. Prior Art

Past materials used in the construction of saddle pads are constructed from woven materials, or are poured from a solidifying material to form a solid poured form. These materials did not allow for sufficient friction between the object being carried and the animal to allow for the stabilization of the item being carried, such as a saddle. An additional problem associated with the prior art materials was a lack of sufficient air flow to allow for air to circulate around the animal's back or carrying area. The prior art materials did not allow for sufficient airflow while providing an adequate amount of cushion and load distribution to protect the animal's back and absorb the shocks associated with load transportation.

The above described saddle pads suffer from the drawbacks of insufficient air circulation, insufficient padding, inadequate frictional surfaces, and insufficient load distribution for properly carrying a weight on an animal. Hence, there is a need for an eloquently simple, non-slip, ventilated, saddle pad.

SUMMARY OF THE INVENTION

In accordance with the present invention, an improved non-slip, ventilated saddle pad apparatus and method is provided which addresses the drawbacks of the prior art devices. In one of its exemplary forms, the invention includes a top and bottom layer sandwiching a middle stiffening layer which are all constructed from poly vinyl chloride impregnated scrim.

In accordance with one embodiment of the present invention, a non-slip ventilated saddle pad is provided which includes a first non-slip top layer, a second non-slip bottom layer, and single or multiple stiffener layers contained between the top layer and the bottom layer where at least one of these layers is constructed from a scrim. The top and bottom layers may be bonded together by stitching or dielectric welding. Each of the top and bottom layers may be different colors and they can be constructed from a poly vinyl chloride material or the like.

In accordance with one example of present invention, the top and bottom layers are constructed from a scrim. The scrim is constructed from fibers knitted into a network having intermittent openings spaced along a surface of the surface of the scrim. The scrim is formed from a knitted construction to provide fibers areas that are sufficient to hold and collect a liquid poly vinyl chloride material. The scrim is also designed to maintain openings that will not hold and collect the liquid poly vinyl chloride material when it is applied. The liquid poly vinyl chloride material imay be chemically blown onto the fibers areas or the entire knitted construction may be dipped into the liquid poly vinyl chloride material.

In accordance with another example of the present invention, the stiffener layer is constructed from ventilated cushion materials to increase the weight distribution area of the saddle pad. This allows the stiffener layer to increase the contact area of the saddle pad.

In accordance with another example of the present invention, the stiffener layer is constructed from a poly vinyl chloride material that may be manufactured in different colors.

In accordance with a still further example of the present invention, the stiffener layer is constructed from a scrim in a similar manner to that associated with the construction of the top and bottom layers as previously discussed.

A further example of the present invention is a method for constructing a saddle pad apparatus, by knitting a scrim from fibers to form a network having both intermittent openings and fiber areas spaced along the surface of the scrim. Then one applies a poly vinyl chloride or the like to the fibers areas of the scrim; and expands the liquid poly vinyl chloride into foam to form a saddle pad.

An additional example of the present invention is a saddle pad construced from a scrim.

One object of the foam-coated pads produced by the process of this invention is the construction of a material that is light weight and low in cost. In addition, the foamed poly vinyl chloride pads of this invention provide a high friction material that can be formulated and produced to resist sliding, by a cohesive or adhesive property, across materials with poor friction properties such as leather or horse hair and horse skin. Thus, rough surfaces or adhesives are not necessary with the present invention to prevent the material from sliding when placed in contact with leather or a horse's back.

A further object of the saddle pad of the present invention is its low moisture absorption, easy cleansing ability, fast drying properties, and the fact that it does not collect and retain horse hair or debris. The material is flexible and allows the formation of contoured pads that properly fit a horse's back.

The principal object of the present invention is to provide a non-slip saddle pad for use with carrying objects on animals.

Another object of the present invention is to provide a ventilating saddle pad for use on animals.

A still further object of the present invention is to provide a saddle pad that will simultaneously adhere to a horse's back and a saddlery.

An additional object of the present invention is to provide the desired protective cushion for a saddle pad.

Yet another object of the present invention is to provide the necessary distribution of weight to increase saddle stabalization.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
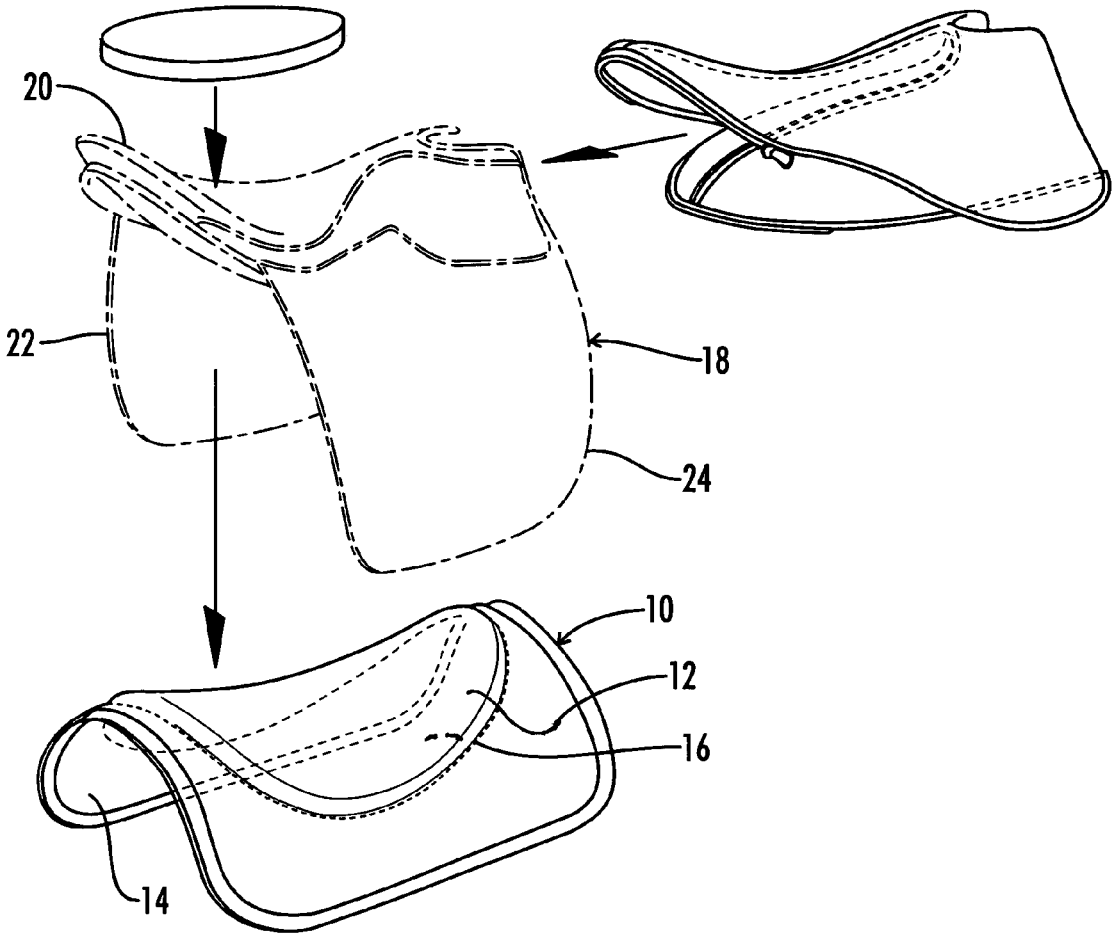
FIG. 1 is an isometric exploded view of a saddle pad of the present invention as used with a saddle.
Figure 2:
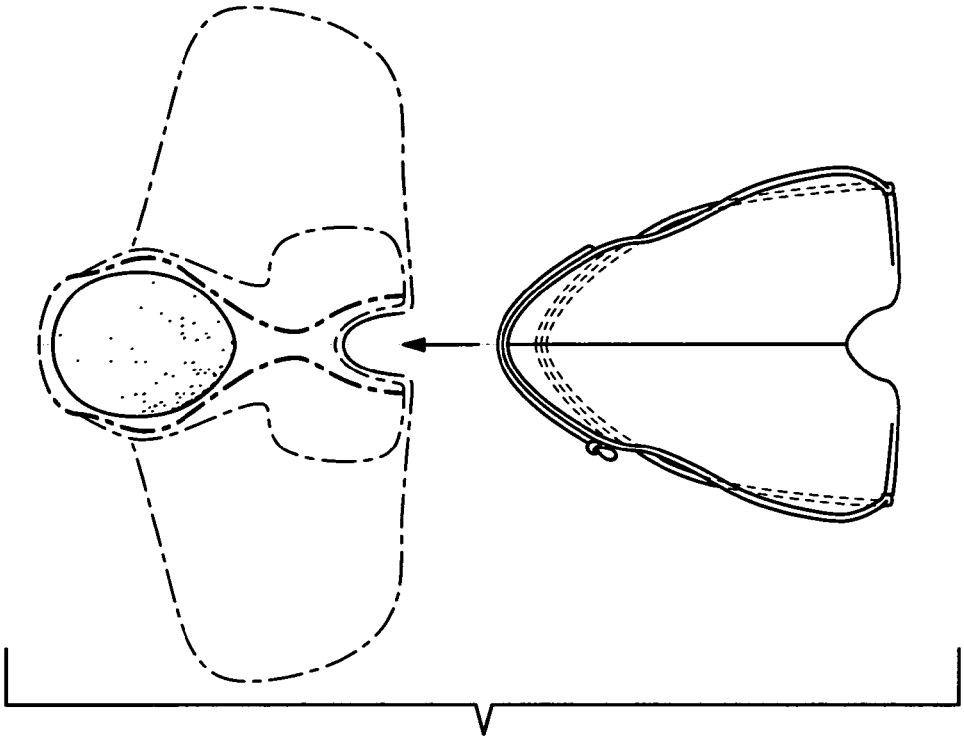
FIG. 2 is a top exploded view of the saddle pad and saddle as shown in FIG. 1.
Figure 3:
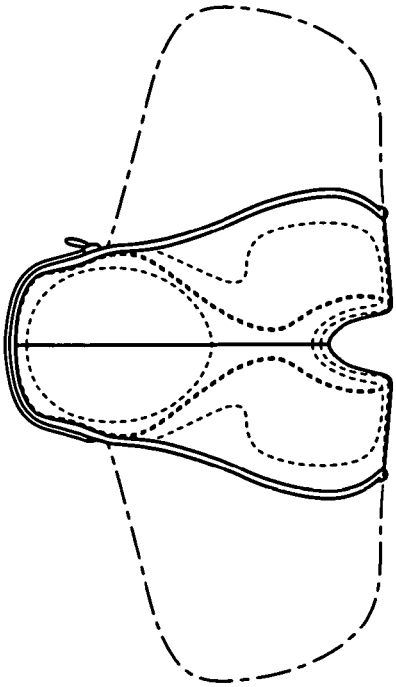
FIG. 3 is a top view of the combined saddle pad and saddle shown in FIGS. 1 and 2.

In accordance with an exemplary embodiment of the present invention as shown in FIGS. 1–9, a saddle pad apparatus, device, or assembly is generally designated by the reference numeral 10.

With reference to FIGS. 1–9, there is shown the basic embodiment of the saddle pad 10 of the present invention consisting of a top layer 12, a bottom layer 14 and a stiffener layer 16. This construction allows for a flexible, form fitting, ventilated, non-slip saddle pad made from a top 12 and bottom 14 outer layer of non-slip material.

The top 12 and bottom 14 layers combine to cover an inner stiffener layer 16 constructed from ventilated stiffener material. This non-slip and ventilated horse saddle pad 10 is made of a cohesive and adhesive poly vinyl chloride foam material that will adhere to a horse's back and simultaneously adhere to the bottom or horse side of saddlery. The material used in the pad 10 can be multiply layered with sufficient plies to provide the desired protective cushion required for the intended use purpose of the individual pad 10 design.

A stiffener rigid inner layer or ply 16 of high density foam sheeting material can also be inserted between the top 12 and bottom 14 outer poly vinyl chloride foam layers to more effectively distribute the total downward weight of the rider and saddle to the horse's back. The stiffener inner layer 16 may be covered with the same adhesive poly vinyl chloride foam material. This material will serve to increase the area of saddle stabilization and the contact area of the saddle and horse in proportion to the size of the total pad. This saddle pad 10 design meets the necessary characteristics of providing a saddle pad 10 that will stay in place, allow air penetration, provide the required cushion for shock absorption. In addition, the multiple layer construction of the saddle pad 10 should be rigid enough to distribute the weight of the saddle and rider over a large enough area to the horse's back to eliminate pressure points and chaffing. Thus, the laminated layers of this saddle pad 10 invention comprise a top 12 and bottom 14 non-slip pad, and single or multiple inner stiffener layers 16 of ventilated cushion materials required to provide sufficient cushion and shock absorption.

The top 12 and bottom 14 outer layers and the inner stiffener layers 16 are permanently bonded together by stitching and or dielectric welding. The dielectrical welding allows the multiple layers 12, 14, and 16 to be spot welded together to achieve the desired level of cushion while maintaining air-flow through the saddle pad 10.

As shown in FIG. 1, a non-slip saddle pad 10 is constructed with stiffener insert 16 between the top 12 and bottom 14 layers. This saddle pad 10 is used to cushion a saddle 18 with a cantle 20 and side flaps 22 and 24.

Figure 4:
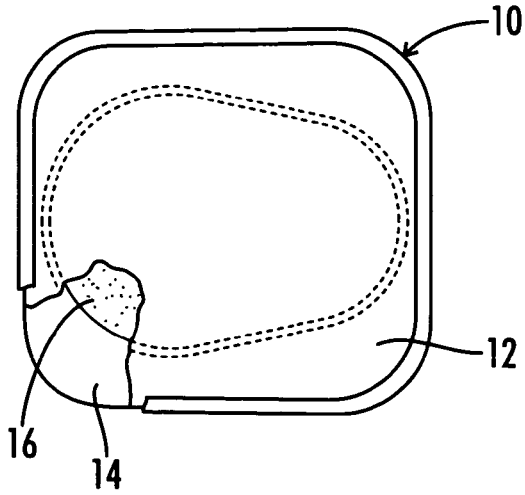
FIG. 4 is a top view of another embodiment of the multiple layer saddle pad of the present invention.
Figure 5:
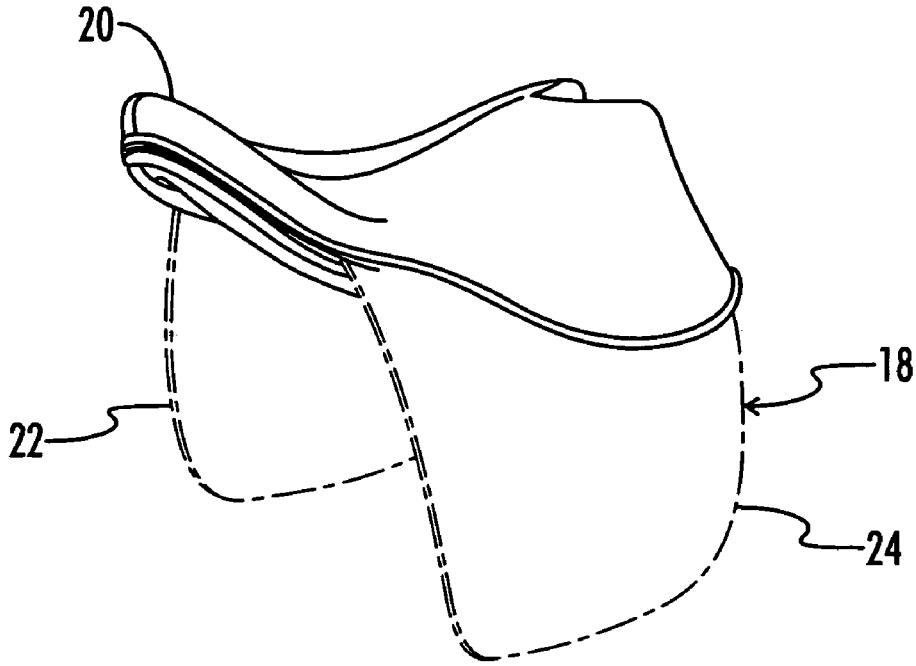
FIG. 5 is an isometric view of a saddle.

As shown in FIG. 4, a cutaway view of the saddle pad 10 of the present invention revels the inner stiffener layer 16. The saddle pad 10 is constructed of two layers, a top layer 12 and bottom layer 14 of non-slip material, which surround an inner stiffener layer 16 of material used to increase the weight distribution area and contact area of the non-slip saddle pad 10.

Figure 6:
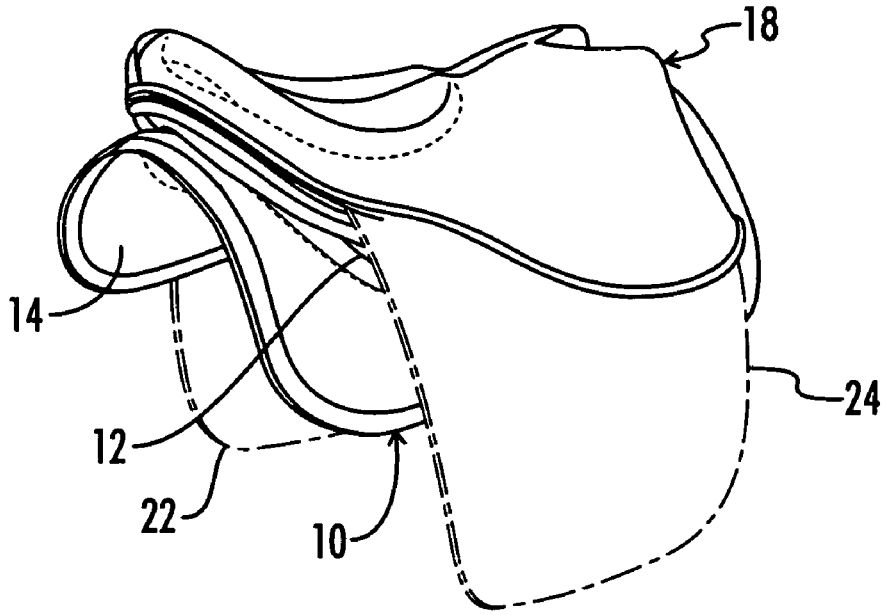
FIG. 6 is an isometric view of the saddle pad of FIG. 4 mounted under the saddle of FIG. 5.

FIG. 6 shows an isometric perspective view of a non-slip saddle pad 10 installed under a saddle 18 including the inner layer of stiffener material 16.

Figure 7:
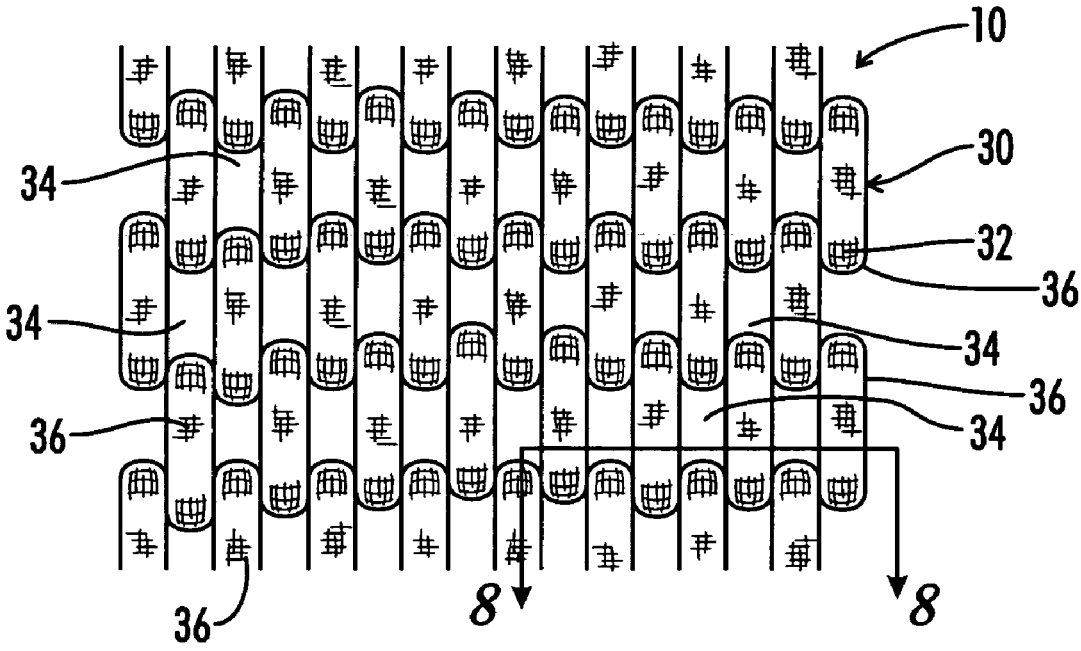
FIG. 7 is a top view of a saddle pad scrim of the present invention.
Figure 8:
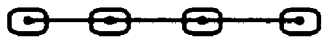
FIG. 8 is an end view of the saddle pad scrim of FIG. 7 along line A—A.
Figure 9:
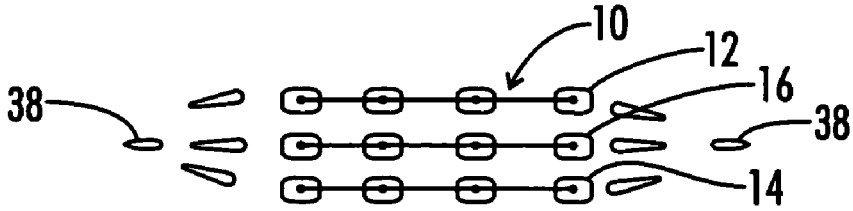
FIG. 9 is an end view of the multiple scrim layers of the saddle pad of the present invention.

As shown in FIGS. 7–9, a scrim 30 is constructed from foam coated material in a open knit pattern that allows air to flow through the pad 10 and dissipate heat. This figure shows a top view of the poly vinyl chloride foam 32 coated material used in the construction of the top 12 and bottom 14 non-slip outer layers of the saddle pad 10. The top and bottom layers 12 and 14 are formed from a scrim 30 coated with a poly vinyl chloride foam 32. The scrim 30 is made of synthetic fibers that are knitted into a network having intermittent openings 34 spaced along the surface of the scrim 32. The scrim 32 is designed and knitted to provide yarn areas 36 that are sufficient to hold and collect liquid poly vinyl chloride. The yarn areas 36 may also be referred to as fibrous areas 36. The alternate openings 34 are areas that will not collect poly vinyl chloride.

The poly vinyl chloride coated scrim 30 of FIGS. 7 to 9 are formed by dipping the knitted synthetic fibers of the scrim 30 in a liquid poly vinyl chloride and then gelling the liquid poly vinyl chloride in a curing oven. As well known in the field of ploy vinyl chloride, a chemical causes gas to be released into the molten poly vinyl chloride which expands the poly vinyl chloride into a foam. The foam then solidifies and creates the scrim 30 as shown in FIG. 7.

Once the poly vinyl chloride has cooled and solidified after the foaming operation, the openings 34 remain in the poly vinyl chloride scrim 30 to produce a soft, resilient, elastomeric foam material with various degrees of surface tack. The desired foam properties can be controlled by changing the types of poly vinyl chloride resins, types of plasticizer, amounts of plasticizer, oven temperatures, and processing speeds used in the manufacture of the scrim 30. The resulting scrim 30 is a uniform cell pattern corresponding to the openings 34 in the scrim 30. However, because the liquid poly vinyl chloride increases in volume as it gells and cools, the scrim 30 pattern from the fiber weave is magnified or increased in size proportionally to the amount of expansion of the poly vinyl chloride.

Different colors of poly vinyl chloride, including black and white, may be used to make different colored pads 10. In addition, differently shaped scrim 30 can be manufactured using the process described.

The fibers used in manufacturing the foam pad scrim 30 increases the tensile strength of the scrim 30 so that they allow the non-slip properties of the blown poly vinyl chloride to be used in this saddle pad 10 application.

FIG. 8 shows an end view of the poly vinyl chloride foam coated material 34 used in the construction of the cushioning inner stiffener layers 16 of the saddle pad 10.

FIG. 9 shows a cross section of the layered saddle pad 10 taken along line A—A in FIG. 7. This figure shows three layers 12, 14, and 16 of poly vinyl chloride foam. Each layer is 0.250" to 0.275" thick and thus, these layers form a total pad 10 thickness of 0.750" minimum. The cells of each layer tend to be compressed by the pressure created by the dieelectric weld seam 38. The finished weld seam 38 is ⅛ the thickness of the original three layers 12, 14, and 16 of material. This weld seam 10 serves as a stabilizing bond point between the three layers 12, 14, and 16 and serves as a break line in the total pad 10 construction which allows the pad 10 to drape and fit acceptably on the horse's back.

The poly vinyl chloride foam impregnated fibers are produced to a specified thickness and hardness for use in the construction of the top 12 and bottom 14 outer layers of the saddle pad 10. In addition, the poly vinyl chloride foam impregnated fibers are produced at another specified hardness for use in construction of the inner layer 16 of the saddle pad 10.

The top 12 and bottom 14 outer layer foam pad material is manufactured at 0.250 to 0.270 inches in thickness with a shore 00 scale hardness of 45 to 55. The inner stiffener layer 16 of foam pad material is manufactured to 0.200 to 0.225 inches of thickness with a shore 00 scale hardness of 75 to 85.

By producing the outer material layers as specified levels of hardness of shore 00 hardness scale 45 to 55 a dry surface coefficient of friction index of 2.1 as obtained by the English XL slipmeter test method can be obtained.

By comparison the dry English XL slipmeter index of the following materials is offered for comparison.

| | |
|---|---|
| DRY ICE | .2 COEFFICIENT OF FRICTION |
| WET ICE | .0 COEFFICIENT OF FRICTION |
| HORSE HAIR | .4 COEFFICIENT OF FRICTION |
| LEATHER | .3 COEFFICIENT OF FRICTION |
| ROUGH CEMENT | 1.2 COEFFICIENT OF FRICTION |
| DENIM TEXTILE | .4 COEFFICIENT OF FRICTION |

The inner stiffener layer 16 of material is designed and manufactured to provide stiffness, air-flow, and durability. The top 12 and bottom 14 outer layer material is designed and manufactured to provide a non-slip surface, air flow, and softness. The manufacturing of the poly vinyl chloride foam pad material and the associated specifications can accomplished varying the raw materials used, the types of chemical compounds used and by varying the oven processing speed and temperature setting combinations.

Although similar materials are sold under different trademarks, the materials used in the preferred embodiments are sold by Vantage Industries of Atlanta Ga. under the trademarks, Sultan, Soft-Grip, and Soft-Tex.

While the foregoing detailed description has described several embodiments of the saddle pad design in accordance with this invention, it is to be understood that the above description is illustrative only and not limiting of the disclosed invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claim or claims, including the full range of equivalency to which each element thereof is entitled.

What is claimed:

1. A saddle pad apparatus, comprising:
a first non-slip top layer;
a second non-slip bottom layer;
at least one stiffener layer contained between said top layer and said bottom layer, wherein at least one layer is constructed from a scrim.

2. The saddle pad apparatus of claim 1, wherein:
said top layer and said bottom layer are bonded together by stitching.

3. The saddle pad apparatus of claim 1, wherein:
said top layer and said bottom layer are bonded together by dielectric welding.

4. The saddle pad apparatus of claim 1, wherein:
said top and bottom layers are different colors.

5. The saddle pad apparatus of claim 1, wherein:
said top and bottom layers are constructed from a poly vinyl chloride material.

6. The saddle pad apparatus of claim 1, wherein:
said top and bottom layers are constructed from a scrim.

7. The saddle pad apparatus of claim 6, wherein:
said scrim is constructed from fibers knitted into a network having intermittent openings spaced along a surface of said scrim.

8. The saddle pad apparatus of claim 7, wherein:
said scrim is knitted to provide fibrous areas that are sufficient to hold and collect a liquid poly vinyl chloride material and still maintain openings that will not hold and collect said liquid poly vinyl chloride material.

9. The saddle pad apparatus of claim 8, wherein:
said liquid poly vinyl chloride material is chemically blown onto said fibrous areas.

10. The saddle pad apparatus of claim 8, wherein:
said liquid poly vinyl chloride material is applied by dipping said fibrous areas into said liquid poly vinyl chloride material.

11. The saddle pad apparatus of claim 1, wherein:
said at least one stiffener layer is constructed from ventilated cushion materials.

12. The saddle pad apparatus of claim 1, wherein:
said at least one stiffener layer increases the weight distribution area of the saddle pad apparatus.

13. The saddle pad apparatus of claim 1, wherein:
said at least one stiffener layer increases the contact area of the saddle pad apparatus.

14. The saddle pad apparatus of claim 1 wherein:
said at least one stiffener layer is constructed from a poly vinyl chloride material.

15. The saddle pad apparatus of claim 1, wherein:
said at least one stiffener layer is constructed from a scrim.

16. The saddle pad apparatus of claim 15, wherein:
said scrim is constructed from fibers knitted into a network having intermittent openings spaced along a surface of said scrim.

17. The saddle pad apparatus of claim 16, wherein:
said scrim is knitted to provide fibrous areas that are sufficient to hold and collect a liquid poly vinyl chloride material and still maintain openings that will not hold and collect said liquid poly vinyl chloride material.

18. The saddle pad apparatus of claim 17, wherein:

said liquid poly vinyl chloride material is chemically blown onto said fibrous areas.

19. The saddle pad apparatus of claim 17, wherein:

said liquid poly vinyl chloride material is applied by dipping said said fibrous areas into said liquid poly vinyl chloride material.

20. A method for constructing a saddle pad apparatus, comprising:

knitting a scrim from fibers to form a network having both intermittent openings and fibrous areas spaced along a surface of said scrim;

applying a poly vinyl chloride to the fibrous areas of said scrim;

expanding said liquid poly vinyl chloride into foam to form a saddle pad apparatus.

* * * * *